US007187899B2

(12) United States Patent
Cao et al.

(10) Patent No.: US 7,187,899 B2
(45) Date of Patent: Mar. 6, 2007

(54) FUSER HAVING REDUCED AXIAL TEMPERATURE DROOP

(75) Inventors: Jichang Cao, Lexington, KY (US); James D. Gilmore, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/142,997

(22) Filed: Jun. 2, 2005

(65) Prior Publication Data

US 2006/0275061 A1 Dec. 7, 2006

(51) Int. Cl.
*G03G 15/20* (2006.01)

(52) U.S. Cl. ..... 399/328; 399/334

(58) Field of Classification Search ..... 399/328, 399/334

See application file for complete search history.

(56) References Cited

U.S. PATENT DOCUMENTS 3,955,813 A * 5/1976 Edwards ..... 271/309
4,541,708 A * 9/1985 Shigenobu ..... 399/33
4,618,240 A 10/1986 Sakurai et al.
5,114,818 A * 5/1992 Yu ..... 430/97
5,212,528 A * 5/1993 Matsuda ..... 399/33
6,118,969 A 9/2000 Curry et al.
6,841,758 B2 * 1/2005 Eskey ..... 219/216

FOREIGN PATENT DOCUMENTS

JP 07064426 A * 3/1995
JP 10207276 A * 8/1998
JP 2000293089 A * 10/2000

* cited by examiner

*Primary Examiner*—David M. Gray
*Assistant Examiner*—Bryan Ready
(74) *Attorney, Agent, or Firm*—Stevens & Showalter, LLP

(57) ABSTRACT

An apparatus is provided for fixing toner to a substrate including a heated fusing roller having a fusing surface. A heater element is located inside the fusing roller. A nip forming member cooperates with the fusing roller to define a fusing nip. A passive temperature control structure including a pair of members is located adjacent opposing end sections of the fusing roller, the passive temperature control structure operating to retain heat in the end sections. The passive temperature control structure may include heat reflecting members located adjacent to peripheral end portions of the hot roller to reflect heat back to the peripheral surface. In addition, the passive temperature control structure may include an end reflector facing axially toward an interior area or the hot roller for reflecting heat back to the interior of the hot roller. The temperature control structure may also comprise a heat dissipating structure including a heat absorbing roller engaged with the fusing roller or ventilation windows formed in a cover over the fusing roller.

16 Claims, 8 Drawing Sheets

FUSER HAVING REDUCED AXIAL TEMPERATURE DROOP

BACKGROUND OF THE INVENTION

1. Field of the Invention

The present invention relates to a fuser construction and, more particularly, to a method and apparatus for controlling an axial temperature distribution in a fuser.

2. Related Prior Art

In an electrophotographic image forming apparatus, such as a printer or copier, a latent image is formed on a light sensitive drum and developed with toner. The toner image is then transferred onto a medium, such as a sheet of paper, and is subsequently passed through a fuser where heat is applied to melt the toner and fuse it to the medium. The fuser includes a fuser roller cooperating with a backup member to form a nip through which the toned media passes. The fuser roller may be provided with an internal heater, such as a halogen lamp, and the temperature of the fuser roller is monitored by a temperature sensor providing a temperature signal for controlling the temperature of the fusing operation to a predetermined target temperature. A common problem encountered in heating the fuser relates to a temperature difference, as measured at different axial locations along the roller, known as axial temperature droop, which may result in gloss variations of the image on the media or other problems. The thermal mass of a heated roller for the fuser, i.e., the fuser roller, typically may be greater at the ends where the roller may be provided with supporting journals, bearings, bushings and drive gears, such that heat flow from the heated roller may be greater at the ends than at a central portion of the roller. In addition, convective and radiated heat energy losses may also occur at the ends of the roller, resulting in the temperature at the ends of the roller tending to decrease more than the central portion of the roller under some conditions.

One solution to axial temperature droop in prior art rollers has been to construct a roller with a relatively thick metal core, providing a relatively large thermal mass to reduce axial temperature droop. The higher thermal mass roller may require a longer warm-up time from room temperature to printing temperature, and the thicker core may cause excessive temperature overshoot after completion of a print job as heat provided from the lamp during the print job continues to pass from the center of the roller to the exterior surface of the roller.

U.S. Pat. No. 6,118,969 describes a fuser roller for eliminating or reducing fuser droop. The described fuser roller includes a distributed mass in which a hollow cylindrical roller is provided with a greater thermal mass per unit length at a center portion of the roller than the thermal mass per unit length of the end portions. A greater thermal mass in one portion of a roller may be accomplished by providing a higher thermal capacity material in the center portion than at the end portions, or by forming the center portion of the roller with a greater thickness than is provided at the end portions.

Providing a fuser roller core with a large thermal mass may result in an undesirable increase in the time for the fuser to warm up to an operating temperature. One prior art solution to providing efficient heating of the roller comprises providing a thin metal, typically steel or aluminum, fixing roller core and including a heater lamp having a boosted filament, which produces more heat at the ends than in the center of the lamp. However, one problem observed during certain conditions of operation of such a fuser roller is that the axial temperature droop may exceed a desired fuser temperature operating window. For example, the fuser roller may exhibit a large axial temperature droop during steady state operation in a standby or print mode of operation. It is typical to provide a temperature sensor for sensing the temperature adjacent one of the end portions of the roller as a feedback temperature for controlling power to the heating element for the fuser roller. When the end portion of the roller drops below the operating temperature, the heating element will be powered to deliver more energy in order to maintain the monitored end portion temperature at the operating temperature. Since the center portion of the roller exhibits less heat loss than the end portions, the temperature of the center portion may increase faster than the temperature at the end portions of the roller, thereby producing a large temperature differential along the axis of the roller.

Accordingly, there continues to be a need for a fuser in which axial temperature droop of a roller in the fuser may be minimized.

SUMMARY OF THE INVENTION

In accordance with one aspect of the invention, an apparatus for fixing a toner image to a substrate is provided including a heated fusing roller. A backup member cooperates with the fusing roller to define a fusing nip. A heat control structure includes structure located adjacent a predetermined axial portion of the fusing roller and reduces the heat flow from the predetermined axial portion relative to a portion of the fusing roller outside of the predetermined axial portion.

In accordance with another aspect of the invention, an apparatus for fixing toner to a substrate is provided including a heated fusing roller having a fusing surface. A heater element is located inside the fusing roller. A nip forming member cooperates with the fusing roller to define a fusing nip. A passive temperature control structure comprising a pair of members is located adjacent opposing end sections of the fusing roller, the passive temperature control structure operating to retain heat in the end sections.

In accordance with a further aspect of the invention, an apparatus for fixing a toner image to a substrate is provided including a fusing roller having a hollow interior area and an exterior fusing surface. A heater element is located inside the fusing roller. A nip forming member cooperates with the fusing roller to define a fusing nip. In addition, a heat reflective structure is provided comprising a reflective surface located adjacent at least one end of the fusing roller and facing axially toward the interior area of the fusing roller.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
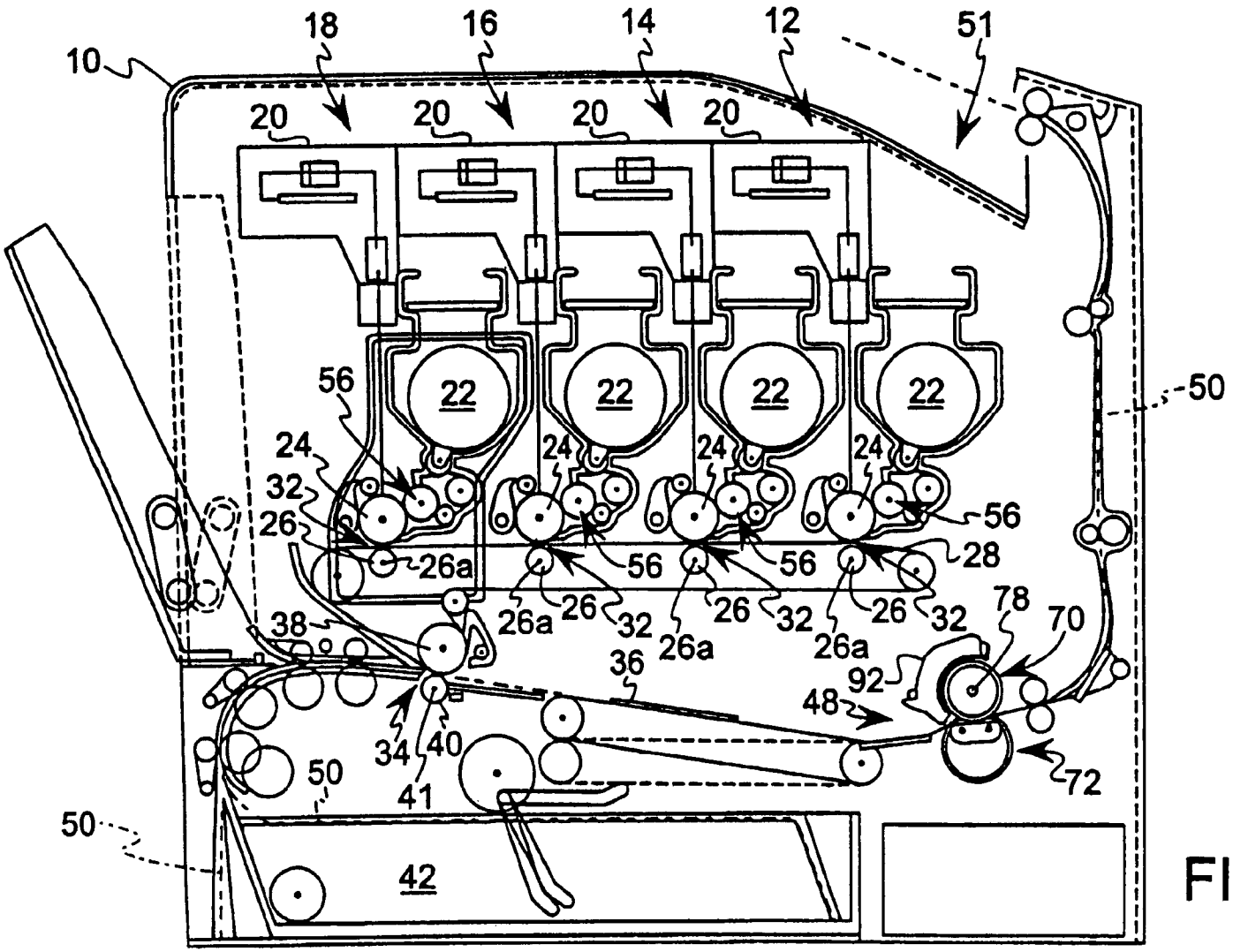
FIG. 1 is a schematic illustration of an electrophotographic printer including a fuser illustrating the present invention.

Referring to FIG. 1, a color electrophotographic (EP) printer 10 is illustrated including four image forming stations 12, 14, 16, 18 for creating yellow (Y), cyan (C), magenta (M) and black (K) toner images. Each imaging forming station 12, 14, 16 and 18 includes a laser printhead 20, a toner supply 22 and a developing assembly 56. Each image forming station 12, 14, 16 and 18 also includes a rotatable photoconductive (PC) drum 24. A uniform charge is provided on each PC drum 24, which is selectively dissipated by a scanning laser beam generated by a corresponding printhead 20, such that a latent image is formed on the PC drum 24. The latent image is then developed during an image development process via a corresponding toner supply 22 and developing assembly 56, in which electrically charged toner particles adhere to the discharged areas on the PC drum 24 to form a toned image thereon. An electrically biased transfer roller 26 opposes each PC drum 24. An intermediate transfer member (ITM) belt 28 travels in an endless loop and passes through a nip defined between each PC drum 24 and a corresponding transfer roller 26. The toner image developed on each PC drum 24 is transferred during a first transfer operation to the ITM belt 28 by an electrically biased roller transfer operation. The four PC drums 24 and corresponding transfer rollers 26 constitute first image transfer stations 32.

At a second image transfer station 34, a composite toner image, i.e., the yellow (Y), cyan (C), magenta (M) and black (K) toner images combined, is transferred from the ITM belt 28 to a substrate 36. The second image transfer station 34 includes a backup roller 38, on the inside of the ITM belt 28, and a transfer roller 40, positioned opposite the backup roller 38. The transfer roller 40 includes a transfer roller shaft 41. Substrates 36, such as paper, cardstock, labels, or transparencies, are fed from a substrate supply 42 to the second image transfer station 34 so as to be in registration with the composite toner image on the ITM belt 28. The composite image is then transferred from the ITM belt 28 to the substrate 36. Thereafter, the toned substrate 36 passes through a fuser assembly 48, where the toner image is fused to the substrate 36. The substrate 36 including the fused toner image continues along a paper path 50 until it exits the printer 10 into an exit tray 51.

The paper path 50 taken by the substrates 36 in the printer 10 is illustrated schematically by a dashed line in FIG. 1. It will be appreciated that other printer configurations having different paper paths may be used. Further, one or more additional media supplies or trays, including manually fed media trays, may be provided.

Figure 2:
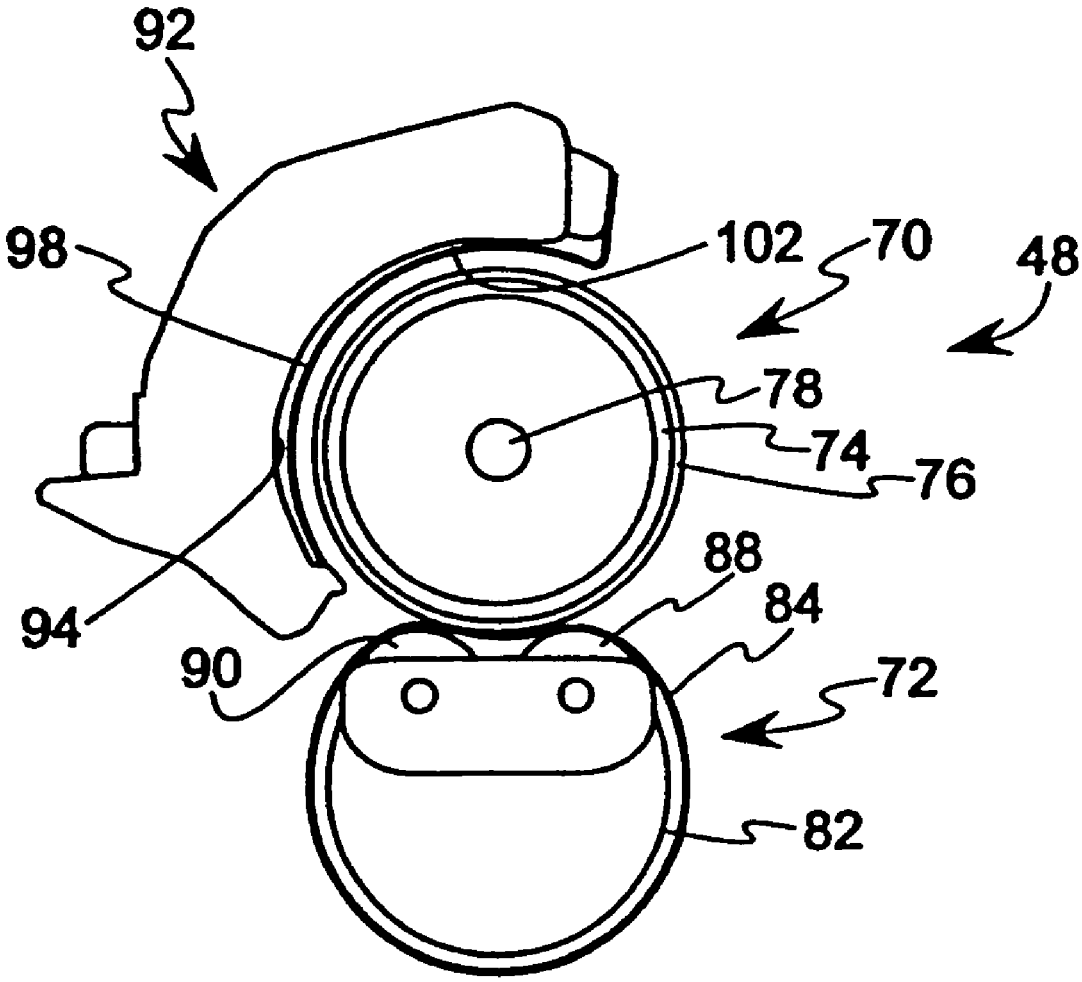
FIG. 2 is a side view of the fuser depicted in FIG. 1.

Referring further to FIG. 2, the fuser assembly 48 in the illustrated embodiment includes a fuser hot roller 70 or fusing roller defining a heating member, and a backup member 72 cooperating with the hot roller 70 to define a nip for conveying substrates 36 (FIG. 1) therebetween. The hot roller 70 may comprise a hollow metal core member 74 covered with a thermally conductive elastomeric material layer 76. The hot roller 70 may also include a PFA (polyperfluoroalkoxy-tetrafluoroethylene) sleeve (not shown) around its elastomeric material layer 76. A heater element 78, such as a halogen tungsten-filament heater, is located inside the core 74 of the hot roller 70 for providing heat energy to the hot roller 70 under control of a print engine controller or processor (not shown). The heater element 78 may comprise a filament that provides an end boost along a predetermined portion adjacent at each end of the heater element 78 to provide a greater heat output adjacent the ends than at a central portion of the heater element 78. It should be understood that the illustrated embodiment is not limited to a particular mechanism or structure for heating the hot roller 70 and that any known means of heating a roller may be implemented within the scope of this invention. In addition, a pair of temperature sensors 80, 81, see FIG. 3, may be provided adjacent opposing ends of the hot roller 70 for sensing a temperature of the hot roller 70 and for sending corresponding signals to the processor.

The backup member 72 may comprise any structure for cooperating with the hot roller 70 to create a nip whereby a substrate passing through the fuser 48 is pressed into engagement with the hot roller 70. In the illustrated embodiment, the backup member 72 does not include a heating element and comprises a backup support 82 for supporting a movable endless belt member 84. The backup support 82 is illustrated as including a pair of support rollers 88, 90 to bias the belt member 84 in a direction toward the hot roller 70. It should be understood that the backup member 72 may comprise other nip forming structures including, without limitation, a cooperating backup roller.

Figure 3:
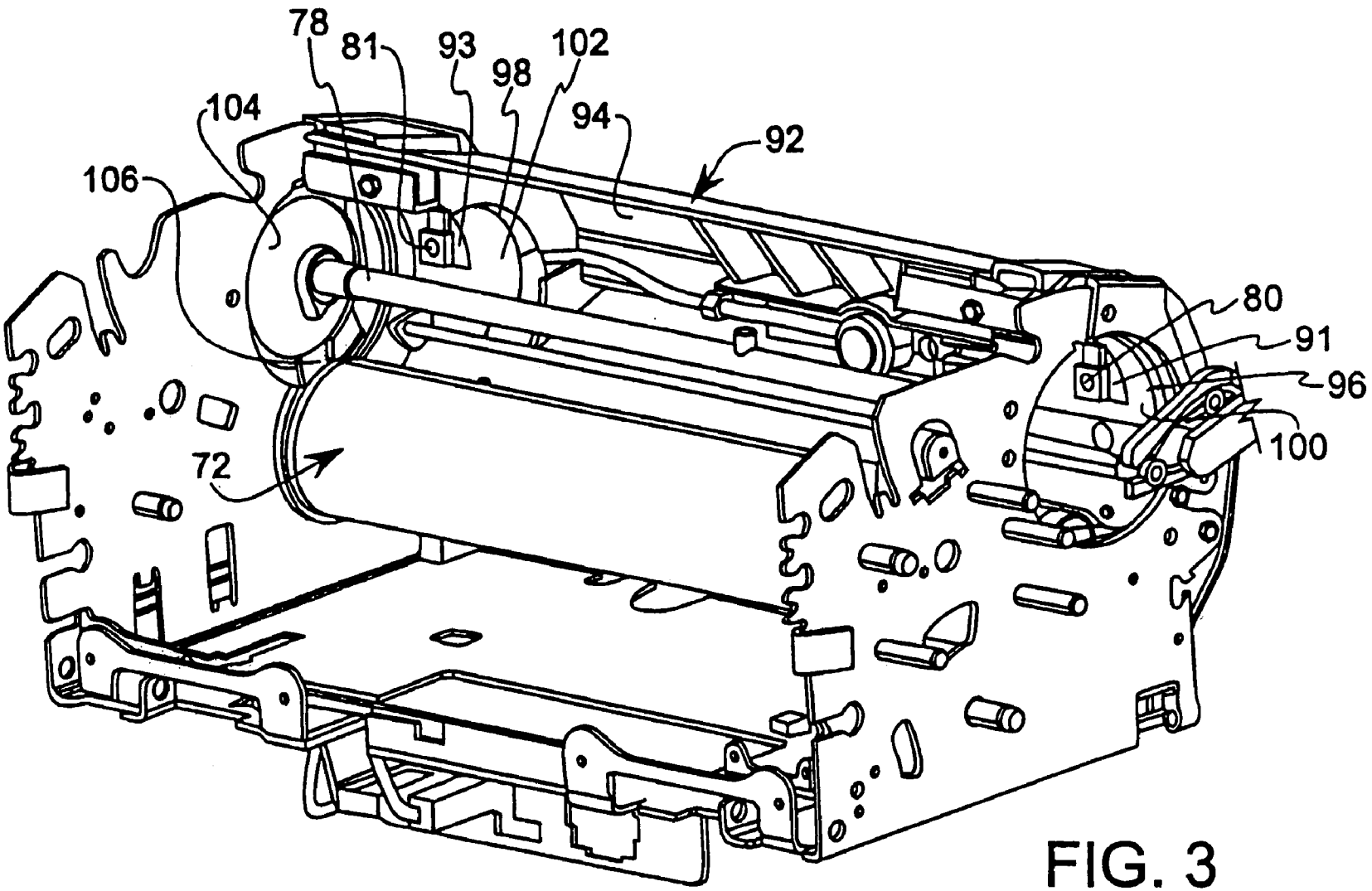
FIG. 3 is a perspective view of a fuser assembly illustrating the present invention in which the hot roller has been removed to show the location of side reflectors and an end reflector.

Referring to FIGS. 2 and 3, the fuser additionally includes a fuser cover 92 extending over the hot roller 70. The cover 92 includes an inner side 94 supporting a pair of spaced side reflector members including a front or gear side reflector 96 located adjacent a drive gear side of the hot roller 70, i.e., a side containing drive gears (not shown) for driving the hot roller 70, and a rear or non-gear side reflector 98 spaced from the gear side reflector 96 and located adjacent a non-gear side of the hot roller 70, see also FIG. 4. The side reflectors 96, 98 are each formed as curved members extending around a circumferential portion of the hot roller 70 closely adjacent and in spaced relation to the exterior or peripheral surface of the hot roller 70. In a preferred example, the side reflectors 96, 98 may extend circumferentially approximately 129° around the circumference of the hot roller 70. Each side reflector 96, 98 defines a center of curvature centered generally at a central longitudinal axis of the hot roller 70. The side reflectors 96, 96 may be spaced approximately 1 to 10 mm from the surface of hot roller 70, and in a preferred non-limiting example, the side reflectors 96, 98 may be spaced approximately 2.6 mm from the surface of the hot roller 70.

The side reflectors 96, 98 each include a reflective inner surface 100, 102, respectively, that is capable of efficiently reflecting radiant energy. For example, the reflectors 96, 98 may be formed of a metal, such as stainless steel, having the inner surfaces 100, 102 polished to a mirror finish for reflecting radiant energy back to the hot roller 70. The cover 92 is formed of a relatively non-reflective material. For example, the cover 92 may be formed of a PET or similar plastic material, and is preferably provided with a non-reflective color such as black.

The side reflectors 96, 98 affect the cooling of the ends of the hot roller 70 to reduce the axial temperature droop. Specifically, the side reflectors 96, 98 return or reflect radiated heat at the end portions of the hot roller 70, reducing heat flow from the end portions, and thereby facilitate sustaining the temperature of the end portions relative to the center portion of the hot roller 70 to minimize the temperature differential between the end portions and the center portion.

It is believed that the axial temperature droop will be at least partially determined by the lengthwise distribution of the side reflectors 96, 98 along the axis of the hot roller 70, where a width dimension of each side reflector 96, 98 may be adjusted to accommodate variations in thermal mass at the ends of the hot roller 70. In particular, in the embodiment of the fuser 48 described herein, the gear side end of the hot roller 70 is considered to have a greater thermal mass than the non-gear side end of the hot roller 70, where the greater thermal mass is believed to cause an axial temperature droop, particularly during a transient temperature phase of the fuser operation, e.g., during warm-up of the fuser 48. Accordingly, in the present embodiment of the fuser 48 it is considered desirable to provide a gear side reflector 96 having a greater width dimension, i.e., the dimension extending in the axial direction, than the width dimension of the non-gear side reflector 98 in order to provide an increased amount of reflected heat at the gear side end of the hot roller 70.

Each of the reflectors 96, 98 is provided with a size to effectively reduce the flow of heat from the hot roller 70, and it is believed that each reflector 96, 98 should have a width dimension equal to or greater than approximately 10% of the overall length of the hot roller 70, as measured along the elastomeric layer 76 of the hot roller 70. In a preferred, non-limiting example, the gear side reflector 96 may be approximately 20.8% of the length of the hot roller 70, and the non-gear side reflector 98 may be approximately 14.5% of the length of the hot roller 70

It should also be noted that if the width dimension of the side reflectors 96, 98 is too great, the heat flow from the center portion of the hot roller 70 may be reduced, which may result in increased axial temperatures at the center of the hot roller 70, with an accompanying increased axial temperature droop. Alternatively, if the width dimension of the side reflectors 96, 98 is too narrow, the heat reflected by the side reflectors 96, 98 may not be adequate to reduce the heat flow at the end portions of the hot roller 70 sufficiently to control the axial temperature droop. In order to avoid a condition in which insufficient heat is allowed to flow from the center portion of the hot roller 70, it is generally considered desirable to provide a width dimension for each of the reflectors 96, 98 that is less than approximately 30% of the length of the hot roller 70.

Further, each of the reflectors 96, 98 may be provided with a respective slot 91, 93 (FIG. 3) for passage of respective thermistors 80, 81 into engagement with an end portion of the hot roller 70.

It should be noted that the reflector structure for implementing the present invention need not be limited to the particular structure described above for the side reflectors 96, 98. For example, other embodiments of reflectors may include, without limitation, reflectors mounted separately from the cover, reflectors formed integrally with the cover, and reflective coatings and/or films supported adjacent the peripheral surface of the hot roller 70, or other constructions capable of returning a substantial portion of the radiated energy back to the surface of the hot roller 70.

In accordance with a further aspect of the invention, at least one end reflector may be provided adjacent at least one end of the hot roller 70 for reflecting heat back toward the interior of the hot roller 70. Specifically, in a preferred embodiment, an end reflector 104 may be provided mounted on the inside surface of a lamp bracket 106 (FIG. 3) at the non-gear side of the hot roller 70. The end reflector 104 faces axially toward the interior area of the hot roller 70 to reflect radiant energy back into hot roller 70 to facilitate sustaining the temperature of the non-gear side of the hot roller 70. The end reflector 104 is generally circular and is formed with a hole at its center for permitting passage of the heater element 78, and may be formed of a metal such as stainless steel, polished to a mirror finish. Alternatively, other reflective structures or materials may be provided including, without limitation, reflectors formed integrally with the lamp bracket, and reflective coatings and or films supported adjacent the end of the hot roller 70. Generally, the end reflector 104 may be formed with any reflective surface capable of reflecting a substantial portion of the radiant energy impinging on the surface defined by the lamp bracket 106 at the non-gear side of the hot roller.

The side reflectors 96, 98 and end reflector 104 define a heat control structure providing passive temperature control for reducing heat flow and/or retaining heat in the hot roller 70 at predetermined axial sections or locations along the hot roller 70. Further, different combinations of the side reflectors 96, 98 and end reflector 104 may be included to obtain desired heat retention characteristics. For example, the gear side reflector 96 may be provided in combination with one of the non-gear side reflector 98 or the end reflector 104, or may be provided in combination with both the non-gear side reflector 98 and the end reflector 104.

Figure 4:
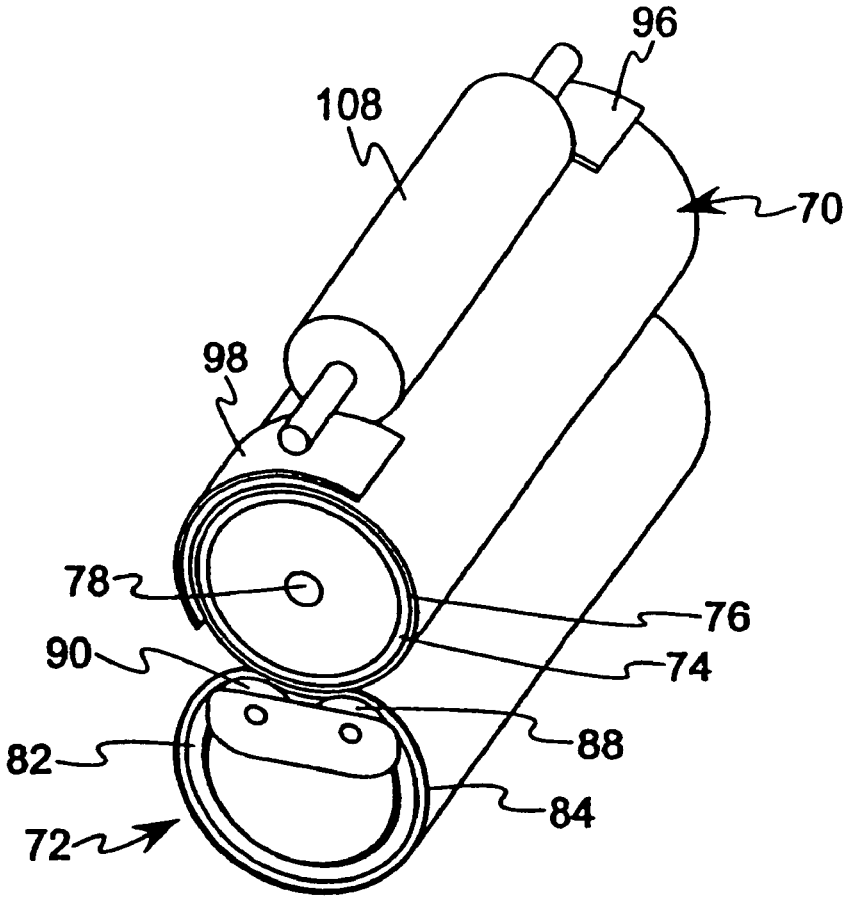
FIG. 4 is a diagrammatic illustration of a further embodiment of the fuser including a heat absorbing roller.

Referring to FIG. 4, an alternative embodiment of the invention is illustrated diagrammatically, in which a heat absorbing member 108, illustrated as a steel roller located between the side reflectors 96, 98, is provided for absorbing heat from a center portion of the hot roller 70. The heat absorbing member 108 may be provided to facilitate reducing the temperature of the center portion of the hot roller 70, and thereby reduce the temperature differential between the ends and the center portion of the hot roller 70. The size of the heat absorbing member 108 may be selected to achieve a reduced axial temperature droop during both transient and steady state operation of the fuser 48.

Figure 5:
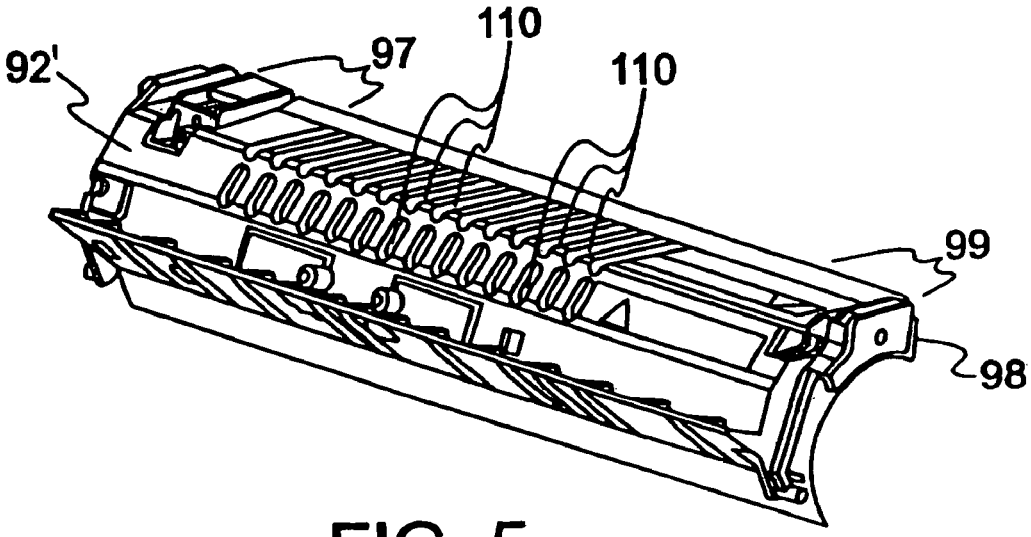
FIG. 5 is a perspective view of a fuser cover for an alternative embodiment of the fuser including ventilation windows in the fuser cover.

Referring to FIG. 5, an alternative embodiment for a cover 92' is illustrated in which a plurality of ventilation apertures or windows 110 are provided in the cover to permit convective heat to pass through the cover 92'. Specifically, the plurality of windows 110 are formed in the cover, beginning at a location adjacent the gear side reflector 96 (identified by section 97), and extending across part of the central portion of the hot roller 70, and stopping at a location axially spaced from the location of the non-gear side reflector 98 (identified by section 99). The windows 110 facilitate convective heat dissipation, and particularly facilitate dissipation of heat from the central portion of the hot roller 70 to reduce the temperature differential between the ends and the center portion of the hot roller 70. Windows 110 may facilitate a reduction in axial temperature droop during steady state operation of the fuser, in that the gear side of the hot roller 70 may tend to maintain a higher temperature than the non-gear side of the hot roller 70 after the hot roller 70 reaches a steady state temperature, e.g., after printing approximately 10 or more pages.

EXAMPLE 1

A fuser was provided including a hot roller 70 having a steel core 74 formed with an outer diameter of approximately 24.8 mm and a thickness of approximately 0.4–0.5 mm, a silicone rubber layer 76 provided over the steel core having a thickness of approximately 0.5–0.6 mm, and a PFA layer provided over the silicone rubber layer 76 having a thickness of approximately 40 microns. The length of the hot roller 70 was approximately 246 mm. The hot roller 70 was engaged with a backup member, such as the backup member 72 described above with reference to FIG. 2, to define a fixing nip between the hot roller 70 and the backup member 72. A 650 W halogen lamp 78 was located in the steel core 74, extending along the central longitudinal axis of the hot roller 70, and including a filament boosted by approximately 10% at each of the opposing ends.

Side reflectors 96, 98 were provided adjacent to the circumferential surface of the hot roller 70 adjacent each end of the hot roller 70, including a gear side reflector 96 having a width of approximately 50 mm extending approximately 129° around the hot roller 70, and a non-gear side reflector 98 having a width of approximately 45 mm extending approximately 129° around the hot roller 70. It is believed that the thermal mass associated with the gear side of the hot roller 70 is greater than the thermal mass associated with the non-gear side, resulting in a greater flow of heat from the gear side than the flow of heat from the non-gear side of the hot roller 70. Accordingly, the side reflector 96 associated with the gear side is larger than the side reflector 98 associated with the non-gear side in order to facilitate retention of heat at the gear side to a greater extent than is provided at the non-gear side. The side reflectors 96, 98 were supported on an inner side 94 of a fuser cover 92 facing toward the hot roller 70. The fuser cover 92 comprised a solid cover without ventilation apertures or windows.

Figure 6:
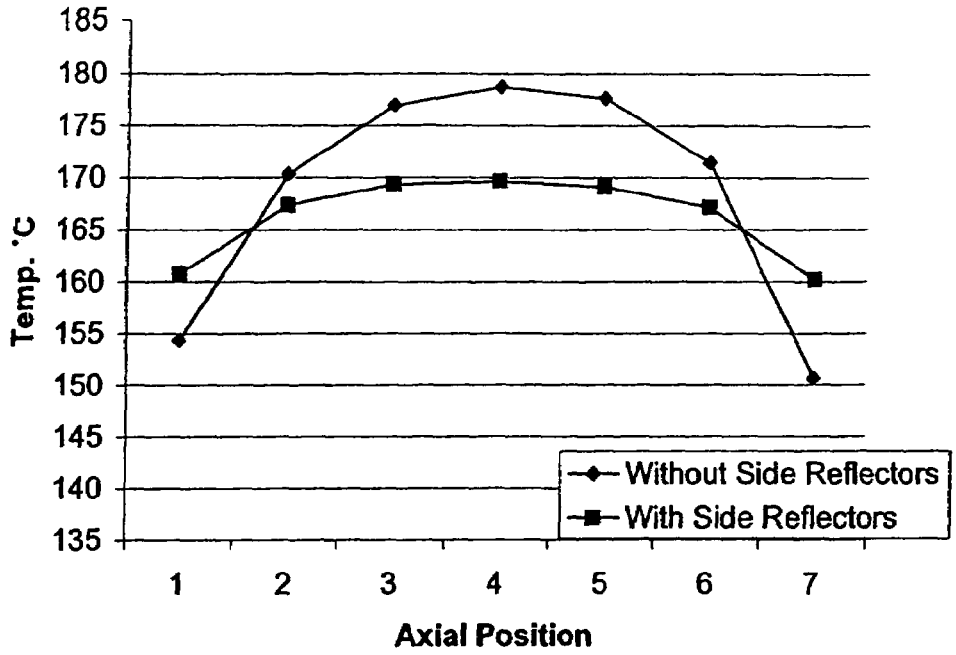
FIG. 6 is a graph illustrating the effect on the steady state temperature of a fuser hot roller provided by including side reflectors adjacent the ends of a hot roller.

FIG. 6 illustrates a temperature profile along the length of the hot roller 70 during steady state operation in a standby mode in which the hot roller 70 and belt 84 were stationary, where the axial position number 1 corresponds to a gear side end and the number 7 corresponds to a non-gear side end of the hot roller 70. A measured steady state axial temperature droop of the hot roller, i.e. the temperature differential between the ends and a central portion of the hot roller, of the fuser provided with the side reflectors 96, 98 was decreased as compared to the steady state hot roller axial temperature droop for a fuser without the side reflectors 96, 98. Specifically, the temperature droop was decreased from greater than approximately 25° C. for the fuser without the side reflectors 96, 98, to less than approximately 10° C. for the fuser with the pair of side reflectors 96, 98.

EXAMPLE 2

In an alternative embodiment of a fuser, a hot roller 70 and backup member 72 as described for Example 1 was provided. Side reflectors 96, 98 were provided adjacent to each end of the hot roller 70, including a gear side reflector 96 having a width of approximately 50 mm extending approximately 129° around the hot roller 70, and a non-gear side reflector 98 having a width of approximately 45 mm extending approximately 129° around the hot roller 70. The side reflectors 96, 98 were supported on an inner side 94 of a fuser cover 92 facing toward the hot roller 70. The fuser cover 92 comprised a solid cover without ventilation windows.

A steel heat absorbing roller 108, as described with reference to FIG. 4, was positioned between the side reflectors 96, 98, where the heat absorbing roller 108 was in engagement with the outer surface of the hot roller 70 during steady state operation in a standby mode in which the hot roller 70 and belt 84 were stationary. The heat absorbing roller 108 had a diameter of approximately 8 mm and was approximately 146 mm long. It is believed that the heat absorbing roller 108 increased the heat dissipated from the center portion of the hot roller 70 relative to the end portions of the roller 70.

Figure 7:
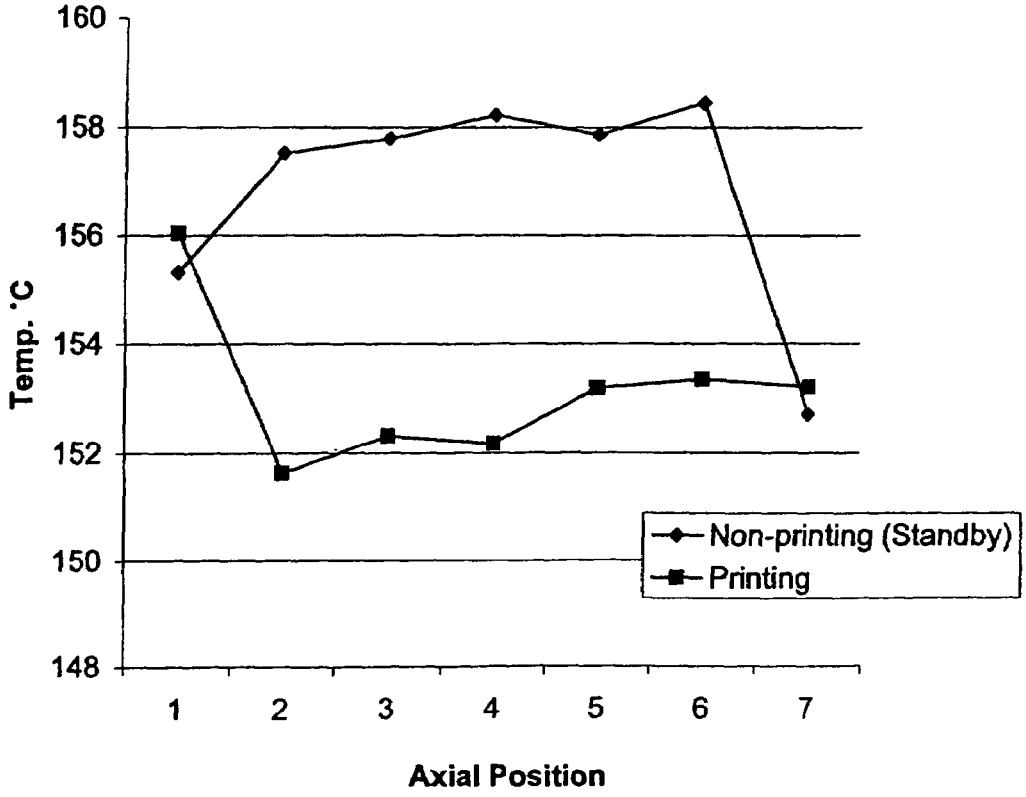
FIG. 7 is a graph illustrating the effect on the steady state temperature of a fuser hot roller provided by including a heat absorbing roller.

Referring to FIG. 7, the steady state temperature droop of a fuser provided with the heat absorbing roller 108 is shown, illustrating that the heat absorbing roller 108 may further decrease the temperature droop, where the axial position number 1 corresponds to a gear side end and the number 7 corresponds to a non-gear side end of the hot roller 70. In particular, it may be seen that the heat absorbing roller 108 may decrease the steady state axial temperature droop of the hot roller 70 such that the axial temperature droop is less than approximately 7° C. In addition, as also illustrated in FIG. 7, the steady state axial temperature profile of the hot roller 70 during a printing operation, i.e., with the hot roller 70 and belt 84 rotating at a process speed of 25 ppm, may reverse from the temperature profile of the hot roller 70 in a standby condition, where the temperature of the roller 70 at the center may be lower than the temperature at the ends during a printing operation. Accordingly, the size of the heat absorbing roller 108 may be limited by the temperature droop associated with a printing mode of operation for the fuser, where additional heat may be drawn from the hot roller 70 by substrates passing through the fuser 48.

EXAMPLE 3

In a third embodiment of a fuser, a hot roller 70 and backup member 72 as described for Example 1 was provided. Side reflectors 96, 98 were provided adjacent to each end of the hot roller 70, including a gear side reflector 96 having a width of approximately 50 mm extending approximately 129° around the hot roller 70, and a non-gear side reflector 98 having a width of approximately 45 mm extending approximately 129° around the hot roller 70. The side reflectors 96, 98 were supported on an inner side 94 of a fuser cover 92' facing toward the hot roller 70. In addition, the fuser cover 92' included ventilation windows 110 for permitting air to pass through the cover 92', as described with reference to FIG. 5. Specifically, a plurality of ventilation windows 110 were provided in at least a portion of the cover 92' extending from the gear side reflector 96 toward the non-gear side reflector 98, where a portion of the cover 92' adjacent the non-gear side reflector 98 was not provided with the ventilation windows 110. In the present example, the ventilation windows 110 extended approximately 83% of the distance from the section 97, corresponding to the gear side reflector 96, toward the section 99, corresponding to the non-gear side reflector, see FIG. 5. Provision of the solid portion of the cover 92', i.e., the portion without ventilation apertures 110 between the section 97 and the last ventilation window 110, was intended to facilitate retention of heat adjacent the non-gear side of the hot roller 70 during a transient phase of fuser operation.

Figure 8:
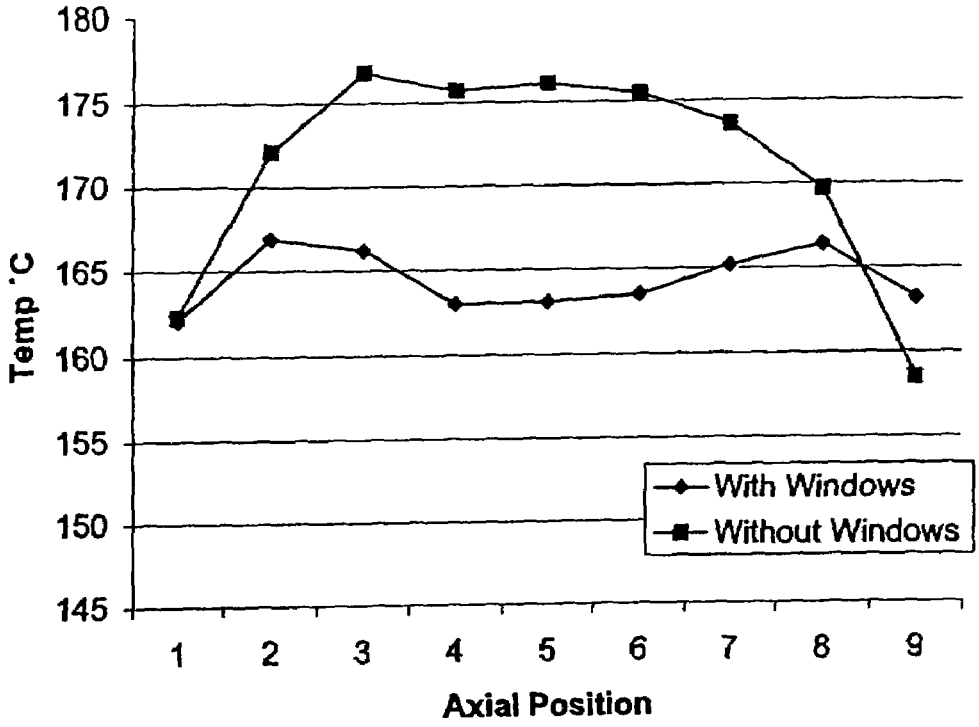
FIG. 8 is a graph illustrating the effect on the steady state temperature of a fuser hot roller provided by including ventilation windows in the fuser cover.

Referring to FIG. 8, the steady state temperature droop of a fuser provided with a cover 92' having the ventilation windows 110 is shown, where the fuser was operated in standby mode in which the hot roller 70 and belt 84 were stationary. FIG. 8 illustrates that the ventilation windows 110 may further decrease the steady state temperature droop, where the axial position number 1 corresponds to a gear side end and the number 7 corresponds to a non-gear side end of the hot roller 70. In particular, it may be seen that the ventilation windows 110 may decrease the steady state axial temperature droop of the hot roller 70 such that the axial temperature droop is less than approximately 5° C.

EXAMPLE 4

In a fourth embodiment, a fuser was provided including a hot roller 70 having a steel core 74 formed with an outer diameter of approximately 43.0 mm and a thickness of approximately 0.55 mm, a silicone rubber layer 76 was provided over the steel core 74 having a thickness of approximately 1.5 mm, and a PFA layer was provided over the silicone rubber layer 74 having a thickness of approximately 40 microns. The length of the hot roller 70 was approximately 239.5 mm. The hot roller 70 was engaged with a backup member, such as the backup member 72 described above with reference to FIG. 2, to define a fixing nip between the hot roller 70 and the backup member 72. A 900 W halogen lamp 78 was located in the steel core 74, extending along the central longitudinal axis of the hot roller 70, and including a filament boosted by approximately 30% at each of the opposing ends.

Side reflectors 96, 98 were provided adjacent to each end of the hot roller 70, including a gear side reflector 96 having a width of approximately 55 mm extending approximately 129° around the hot roller 70, and a non-gear side reflector 98 having a width of approximately 35 mm extending approximately 129° around the hot roller 70. The side reflectors 96, 98 were supported on an inner side 94 of a fuser cover 92 facing toward the hot roller 70. The fuser cover 92 comprised a solid cover without ventilation windows.

In addition, an end reflector 104 was provided mounted to the inside surface of a lamp bracket 96 at the non-gear side of the hot roller 70. The end reflector 104 had a diameter of approximately 35 mm and included a central opening for passage of the heater lamp 78 to engage with the lamp bracket 106. The end reflector 104 was formed of polished stainless steel. The end reflector 104 was provided to reflect a substantial portion of the radiant energy arriving at the lamp bracket back to the interior of the hot roller 70 in order to further limit a temperature decrease at the non-gear side of the hot roller 70.

Figure 9:
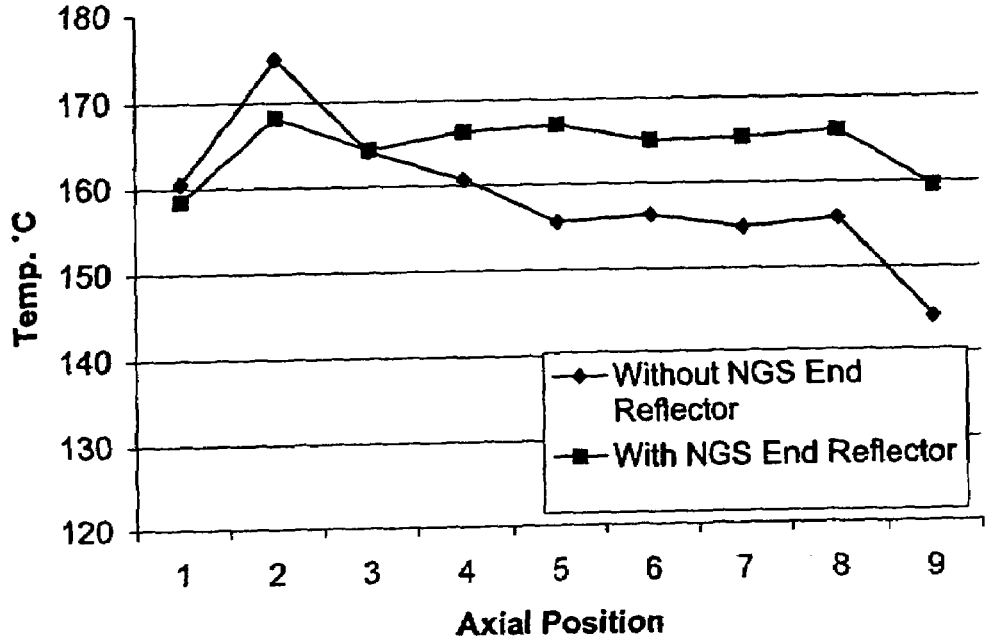
FIG. 9 is a graph illustrating the effect on the transient temperature of a fuser hot roller provided by including an end reflector directed toward the interior of the hot roller.
Figure 10:
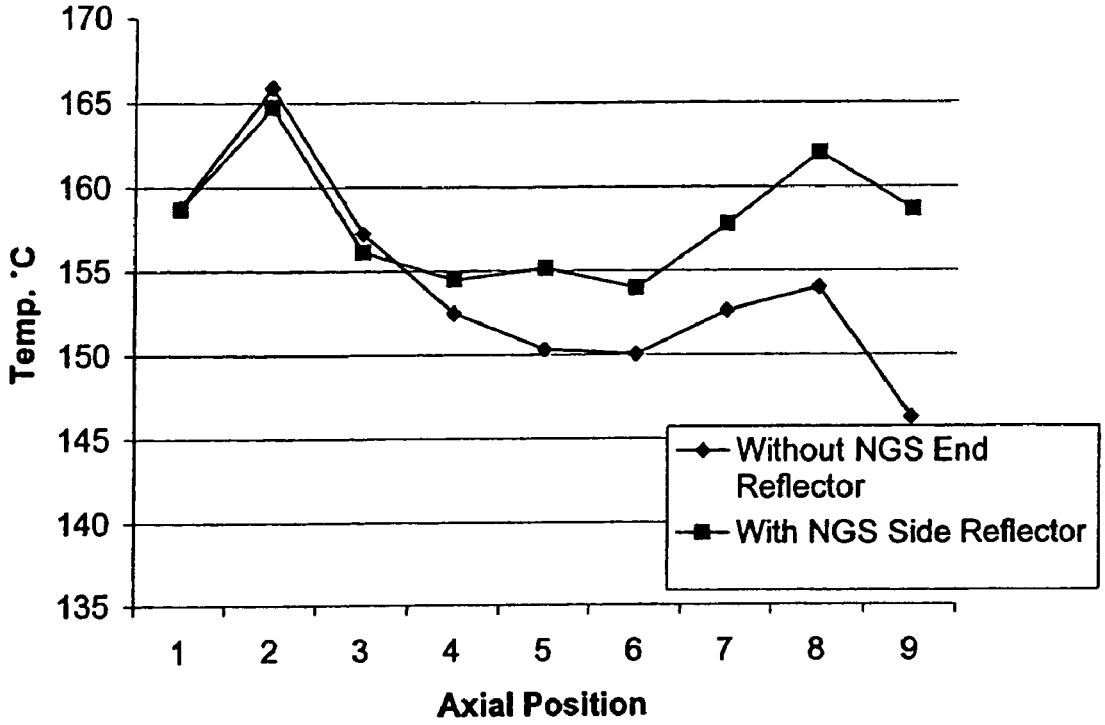
FIG. 10 is a graph illustrating the effect on the steady state temperature of a fuser hot roller provided by including an end reflector directed toward the interior of the hot roller.

Tests were run on the fuser in a print mode with and without the end reflector 104 on the inside surface of the lamp bracket 106, the results of which are illustrated in FIG. 9 showing the transient temperature distribution, i.e., during printing of a first substrate, and FIG. 10 showing the steady state temperature distribution, where the axial position number 1 corresponds to a gear side end and the number 9 corresponds to a non-gear side end of the hot roller 70. In addition, the results are summarized in Table 1 below, describing the axial temperature droop for transient and steady state operation.

TABLE 1

| Configuration | Transient | Steady State |
|---|---|---|
| 30 ppm/No End Reflector | 31° C. | 19° C. |
| 30 ppm/With End Reflector | 10° C. | 11° C. |

It can be seen that the addition of an end reflector 104 to the non-gear side lamp bracket 106 appeared to reduce the axial temperature droop from 31° C. to 10° C. during transient operation, e.g., during processing of a substrate, at 30 ppm, and appeared to reduce the axial temperature droop from 19° C. to 11° C. during steady state operation at 30 ppm. Thus, the addition of the end reflector 104 on the non-gear side of the hot roller 70 was considered to substantially reduce the axial temperature droop in both transient and steady state operation of the fuser.

EXAMPLE 5

The effect of including the non-gear side reflector 98 on a hot roller 70 having an end reflector 104 mounted to the non-gear side lamp bracket 106, was illustrated by performing tests on a fuser constructed in accordance with a fifth embodiment. In the fifth embodiment, a hot roller 70 and backup member 72 as described for Example 4 was provided. A gear side reflector 96 was provided adjacent to the gear side of the hot roller 70, where the reflector 96 comprised a width of approximately 55 mm extending approximately 129° around the hot roller 70. The gear side reflector 96 was supported on an inner side 94 of a fuser cover 92 facing toward the hot roller 70. The fuser cover 92 comprised a solid cover without ventilation apertures.

Figure 11:
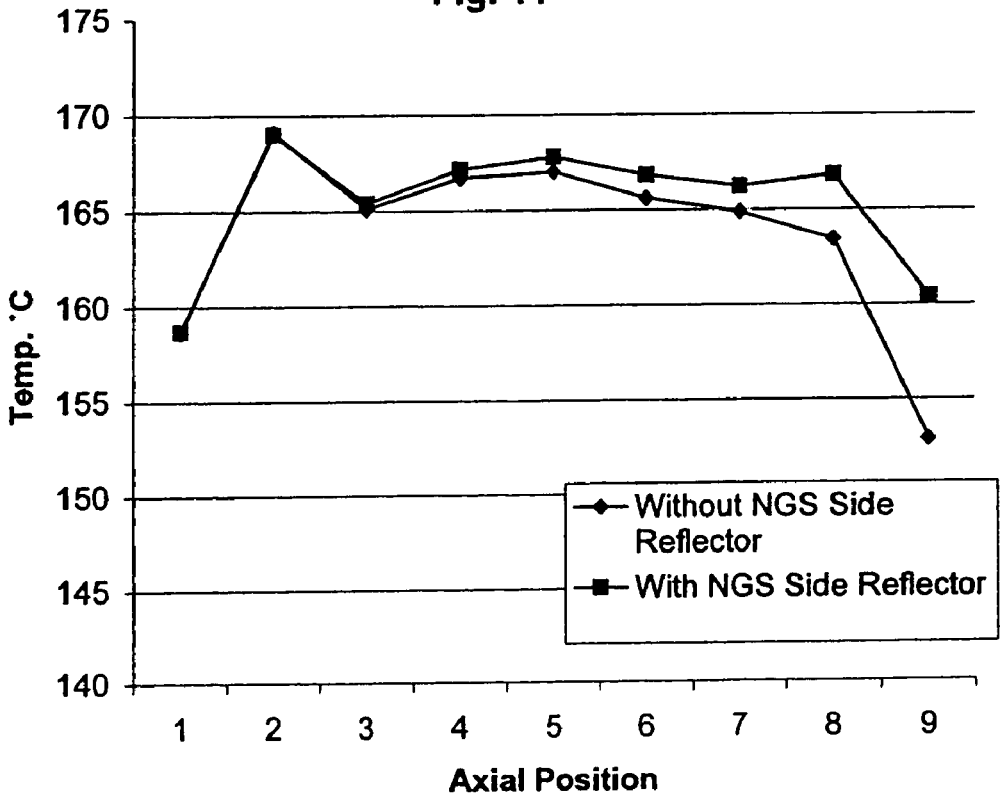
FIG. 11 is a graph illustrating the effect on the transient temperature of a fuser hot roller operating at 30 ppm provided by including a non-gear side reflector in combination with an end reflector directed toward the interior of the hot roller.
Figure 12:
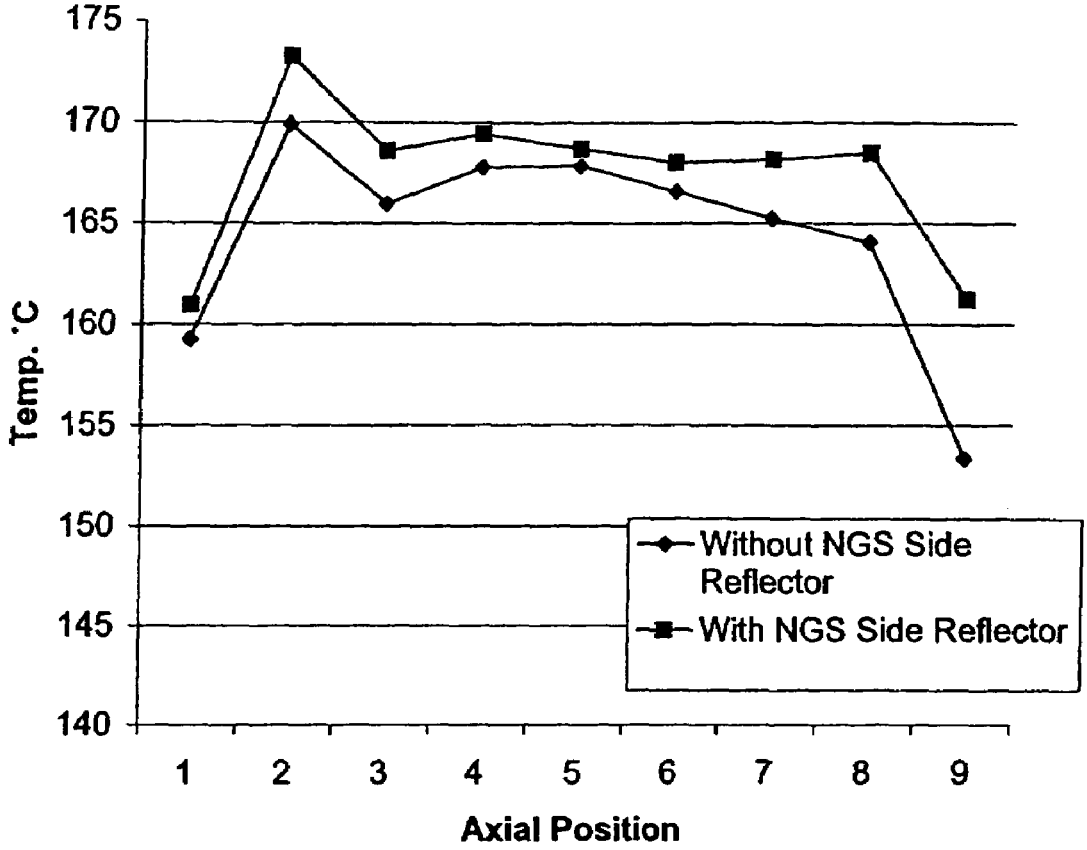
FIG. 12 is a graph illustrating the effect on the transient temperature of a fuser hot roller operating at 40 ppm provided by including a non-gear side reflector in combination with an end reflector directed toward the interior of the hot roller.
Figure 13:
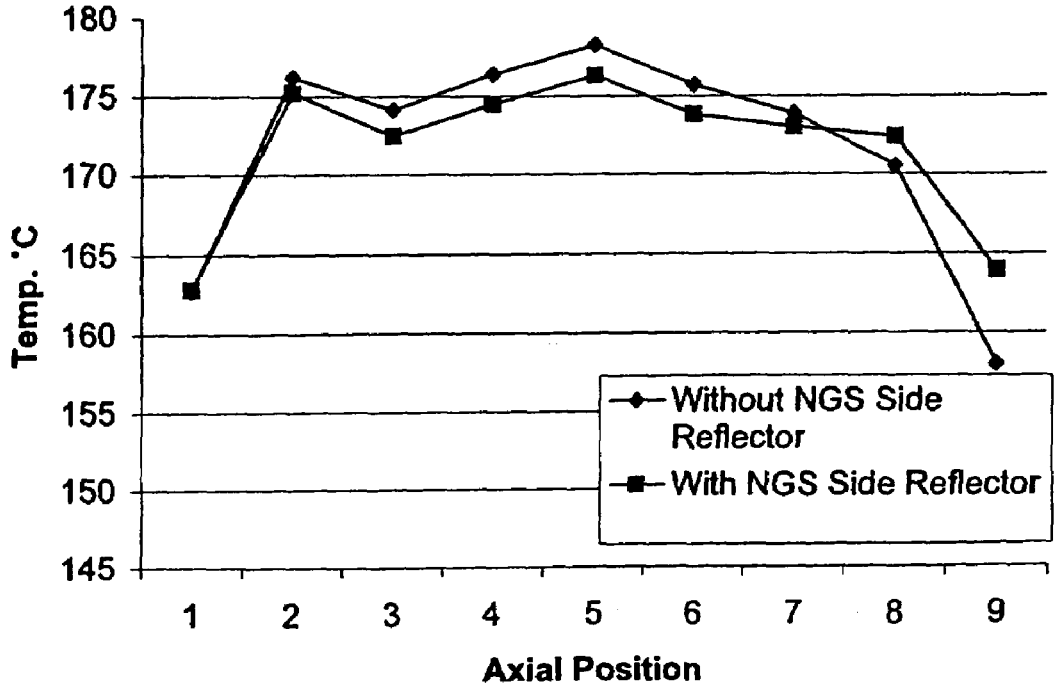
FIG. 13 is a graph illustrating the effect on the transient temperature of a fuser hot roller operating in standby provided by including a non-gear side reflector in combination with an end reflector directed toward the interior of the hot roller.

In accordance with the construction of this Example, a non-gear side reflector, i.e., the reflector 98, was not provided. However, an end reflector 104 was provided mounted to the inside surface of the lamp bracket 106 at the non-gear side of the hot roller 70. The end reflector 104 had a diameter of approximately 35 mm and included a central opening for passage of the heater lamp 78 to engage with the lamp bracket 106. The lamp bracket 106 mounted end reflector 104 was a reflector as described above for Example 4. The fuser configuration of the present Example was compared to the configuration described above for the fourth embodiment of Example 4 for operation at 30 ppm, at 40 ppm and in a standby mode of operation. The transient temperature distribution results from this comparison are shown in FIGS. 11 and 12 for printing at process speeds of 30 ppm and 40 ppm, respectively, where the axial position number 1 corresponds to a gear side end and the number 9 corresponds to a non-gear side end of the hot roller 70. Also, steady state temperature distribution results from this comparison are shown in FIG. 13 for operation in a standby mode with the hot roller 70 and the belt 84 stationary. In addition, the results are summarized in Table 2 below, describing the axial temperature droop for transient and steady state operation.

TABLE 2

| Configuration | Transient | Steady State |
|---|---|---|
| 30 ppm/No NGS Reflector | 16° C. | 11° C. |
| 30 ppm/With NGS Reflector | 10° C. | 11° C. |
| 40 ppm/No NGS Reflector | 17° C. | 10° C. |
| 40 ppm/With NGS Reflector | 12° C. | 10° C. |
| Standby/No NGS Reflector | — | 20° C. |
| Standby/With NGS Reflector | — | 13° C. |

It can be seen that adding a non-gear side (NGS) reflector 98 in addition to the lamp bracket mounted end reflector 104, i.e., the configuration of Example 4, provided a reduced axial temperature droop from approximately 16° C. to 10° C. during transient operation at 30 ppm; and reduced the axial temperature droop from approximately 17° C. to 12° C. during transient operation at 40 ppm. It can also be seen that the axial temperature droop during steady state operation remained substantially the same with the addition of the non-gear side reflector 98 during operation in the printing mode at both 30 ppm and at 40 ppm process speeds.

It further may be noted that the steady state axial temperature droop during a standby mode of operation, when the hot roller 70 and belt 84 were not rotating, was reduced from approximately 20° C. to 13° C. with the addition of the non-gear side reflector 98. A reduction in axial temperature droop during standby may be considered to facilitate a reduction in axial temperature droop at the beginning of a print job after exiting the standby mode.

Thus, it was observed that the end reflector 104, without the non-gear side reflector 98, maintained the axial temperature droop within an acceptable range during printing mode steady state operation; and that the provision of both the non-gear side reflector 98 and the end reflector 104 substantially improved the axial temperature distribution during transient operation of the hot roller 70 during printing mode; while also maintaining the steady state axial temperature distribution within an acceptable range, i.e., within approximately 10–11° C., for the printing mode and substantially reducing the steady state axial temperature droop during the standby mode.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for fixing a toner image to a substrate comprising:

a heated fusing roller having an outer peripheral surface, backup member cooperating with said fusing roller to define a fusing nip; and a heat control structure comprising a first member comprising a heat reflective surface, said first member being located such that said heat reflective surface is located radially outwardly from said outer peripheral surface of said fusing roller so as to reflect radiant energy back to said fusing roller peripheral surface, and said heat control structure further comprising a second member, said first and second members located in spaced relation to each other and located adjacent to respective ends of said fusing roller.

2. An apparatus as set forth in claim 1 wherein said first member heat reflective surface is located adjacent at least one end of said fusing roller.

3. An apparatus as set forth in claim 2 wherein said heat reflective surface extends axially along said peripheral surface.

4. An apparatus as set forth in claim 2 wherein said fusing roller defines a hollow interior area and further comprising a reflective surface located adjacent at least one end of said fusing roller and facing said interior area.

5. An apparatus as set forth in claim 4 including a heating lamp located in said interior area.

6. An apparatus as set forth in claim 1 wherein said first and second members define different width dimensions from each other, extending in the axial direction.

7. An apparatus as set forth in claim 1 wherein said heat control structure further comprises a heat dissipating structure located adjacent a second predetermined portion of said fusing roller between said first and second members.

8. An apparatus as set forth in claim 7 wherein said fuser includes a cover extending over said fusing roller and said heat dissipating structure further comprises an open portion defined by one or more windows in said cover.

9. An apparatus as set forth in claim 1 wherein said heat control structure further comprises a heat absorbing roller in engagement with said fusing roller at a circumferentially spaced location from said fusing nip, and axially spaced from said first member.

10. An apparatus for fixing a toner image to a substrate comprising:

a heated fusing roller having a fusing surface;

a heater element located inside said fusing roller;

a nip forming member cooperating with said fusing roller to define a fusing nip; and passive temperature control structure comprising a pair of members located adjacent opposing end sections of said fusing roller, said passive temperature control structure members operating to retain heat in said end sections and at least one of said members being located radially outwardly from said fusing roller surface so as to reflect radiant energy back to said fusing roller surface, said members comprise reflective surfaces located in facing relationship to said fusing surface adjacent said end sections of said fusing roller.

11. An apparatus as set forth in claim 10 wherein said reflective surfaces define a radius of curvature substantially centered about a rotational axis of said fusing roller and are substantially straight in a direction parallel to a longitudinal axis of said fusing roller.

12. An apparatus as set forth in claim 10 further comprising a fuser cover comprising a substantially non-reflective surface.

13. An apparatus as set forth in claim 12 including holes defined in said fuser cover providing convective heat transfer through said cover along a central portion of said fusing roller.

14. An apparatus as set forth in claim 13 wherein said holes are axially offset toward one end of said fusing roller.

15. An apparatus as set forth in claim 10 wherein said fusing roller comprises a hollow interior and said passive temperature control structure further comprises a reflective surface located at one end of said fusing roller and facing into said hollow interior for reflecting radiation axially into said fusing roller.

16. An apparatus as set forth in claim 1 wherein said heat reflective surface is substantially straight in a direction parallel to a longitudinal axis of said fusing roller.

* * * * *